US007592985B2

(12) United States Patent
Kim et al.

(10) Patent No.: US 7,592,985 B2
(45) Date of Patent: Sep. 22, 2009

(54) DRIVING APPARATUS FOR ORGANIC ELECTRO-LUMINESCENCE DISPLAY DEVICE

(75) Inventors: Ji Hun Kim, Seoul (KR); Hak Su Kim, Seoul (KR); Hee Young Lee, Daegu (KR)

(73) Assignee: LG Electronics Inc., Seoul (KR)

( * ) Notice: Subject to any disclaimer, the term of this patent is extended or adjusted under 35 U.S.C. 154(b) by 571 days.

(21) Appl. No.: 11/042,065

(22) Filed: Jan. 26, 2005

(65) Prior Publication Data

US 2006/0066526 A1 Mar. 30, 2006

(30) Foreign Application Priority Data

Sep. 30, 2004 (KR) ..... 10-2004-0078087

(51) Int. Cl.
*G09G 3/32* (2006.01)

(52) U.S. Cl. ..... 345/82; 345/76; 315/169.2

(58) Field of Classification Search ..... 345/76, 345/77, 82, 83; 315/169.3, 171, 169.2
See application file for complete search history.

(56) References Cited

U.S. PATENT DOCUMENTS 6,084,579 A * 7/2000 Hirano ..... 345/76
6,496,168 B1 * 12/2002 Tomida ..... 345/76
6,960,889 B2 * 11/2005 Park et al. ..... 315/169.3
7,079,092 B2 * 7/2006 Tanghe et al. ..... 345/82
7,253,665 B2 * 8/2007 Kimura ..... 315/169.3
2003/0184237 A1 10/2003 Togashi et al.
2004/0178407 A1 * 9/2004 Lin ..... 257/40

FOREIGN PATENT DOCUMENTS

EP 1 291 838 A1 3/2003
EP 1 445 757 A1 8/2004

* cited by examiner

*Primary Examiner*—Kevin M Nguyen
(74) *Attorney, Agent, or Firm*—Birch, Stewart, Kolasch & Birch, LLP

(57) ABSTRACT

A driving apparatus for an organic electro-luminescence display device for reducing a deterioration of organic light-emitting diode device in the organic electro-luminescence display device is disclosed. In the driving apparatus, a data supplier supplies a data signal to an anode of an organic light-emitting diode device. A first voltage source generates a first voltage. A second voltage source generates a second voltage higher than said first voltage. A voltage stabilizer stabilizes said second voltage to be supplied to the cathode of the organic light-emitting diode device. First and second switching devices selectively apply said first and second voltages to a cathode of the organic light-emitting diode device.

4 Claims, 15 Drawing Sheets

DRIVING APPARATUS FOR ORGANIC ELECTRO-LUMINESCENCE DISPLAY DEVICE

This application claims the benefit of Korean Patent Application No. P2004-78087 filed in Korea on Sep. 30, 2004, which is hereby incorporated by reference.

BACKGROUND OF THE INVENTION

1. Field of the Invention

This invention relates to an organic electro-luminescence display (ELD), and more particularly to a driving apparatus for an organic electro-luminescence display device that is adaptive for reducing a deterioration of organic light-emitting diode device in the organic electro-luminescence display device.

2. Description of the Related Art

Recently, there have been developed various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) display, etc. device.

In such flat panel display devices, the PDP has the most advantage for making a large dimension screen because its structure and manufacturing process are simple, but has a drawback in that it has low light-emission efficiency and large power consumption. The LCD has a difficulty in making a large dimension screen because it is fabricated by a semiconductor process, but has an expanded demand as it is mainly used for a display device of a notebook personal computer. However, the LCD has a drawback in that it has a difficulty in making a large dimension screen and it has large power consumption due to a backlight unit. Also, the LCD has characteristics of a large light loss and a narrow viewing angle due to optical devices such as a polarizing filter, a prism sheet, a diffuser and the like.

On the other hand, the EL display device is largely classified into an inorganic EL device and an organic EL device depending upon a material of a light-emitting layer, and is a self-luminous device. When compared with the above-mentioned display devices, the EL display device has advantages of a fast response speed, large light-emission efficiency, a large brightness and a large viewing angle. The organic EL display device can display a picture at approximately 10[V] and a high brightness of ten thousands of [cd/m$^2$].

FIG. 1 is a schematic section view showing a structure of a conventional organic EL display device.

In the organic EL display device 1, as shown in FIG. 1, an anode electrode 2 is formed from a transparent electrode pattern on a substrate 1. On the substrate 1, a hole carrier layer 3, a light-emitting layer 4 formed from an organic material, an electron carrier layer 5 and a cathode 6 made from a metal are disposed.

FIG. 2 is a circuit diagram of a driving apparatus for the conventional organic EL display device, and FIG. 3 is a circuit diagram for explaining an operation principle of an organic light-emitting diode device in the organic EL display device shown in FIG. 2. Further, FIG. 4 is a driving waveform diagram of the organic EL display device shown in FIG. 2.

Referring to FIG. 2 to FIG. 4, the driving apparatus for the conventional organic EL display device includes a data voltage source Vdata connected to an anode of an organic light-emitting diode device 20, first and second scan voltage sources Vin1 and Vin2 connected to a cathode of the organic light-emitting diode device 20.

The data voltage source Vdata supplies a positive voltage to data lines DL1 to DLm of the organic EL display device while the first and second scan voltage sources Vin1 and Vin2 supply a negative voltage and a positive voltage to scan lines SL1 to SLn of the organic EL display device.

Generally, the driving apparatus for the organic EL display device applies the same voltage to the data voltage source Vdata supplying a positive voltage to the data lines DL1 to DLm and the second scan voltage source Vin2 supplying a positive voltage to the scan lines SL1 to SLn. A ground voltage GND is applied to the first scan voltage source Vin1 supplying a negative voltage to the san lines SL1 to SLn.

Further, the driving apparatus includes switching devices 21 connected between the anode of the organic light-emitting diode device 20 and the data voltage source Vdata, and first and second switching devices 22 and 23 connected between the cathode of the organic light-emitting diode device 20 and the first and second scan voltage sources Vin1 and Vin2, respectively.

The first switching devices 22 are sequentially turned on in response to a control signal T1 to thereby sequentially apply a scanning pulse SCAN having a negative voltage, that is, a forward voltage to the scan lines SL1 to SLn. A data pulse DATA is synchronized with the scanning pulse SCAN applied to the scan lines SL1 to SLn to be applied to the data lines DL1 to DLm as a positive voltage.

More specifically, as the first switching device 22 connected to the first scan line SL1 is turned on in response to the control signal T1, the scanning pulse SCAN is applied to the first scan line SL1 as a negative voltage. At the same time, the data pulse DATA is applied to the data lines DL1 to DLm as a positive voltage. When a negative voltage is applied to the first scan line SL1 and a positive voltage is applied to the data lines DL1 to DLm, the organic light-emitting diode device 20 at the first line is emitted by a forward bias. Thereafter, as the second switching device 23 connected to the first scan line SL1 is turned on in response to a control signal T1, the scanning pulse SCAN is applied to the first scan line SL1 as a positive voltage. While the control signal T2 supplying a positive voltage to the first scan line SL1 and the first control signal T1 supplying a negative voltage to the second scan line SL2 being applied, the organic EL display device sequentially emits a light to display a picture.

FIG. 5 is a detailed view of the A portion shown in FIG. 4.

Referring to FIG. 5, when the scanning pulse SCAN is switched from a negative voltage into a positive voltage, an overshoot phenomenon caused by the switching emerges from the scanning pulse SCAN. Such an overshoot phenomenon causes a deterioration of the organic light-emitting diode devices 20. This appears more seriously as a level of the positive voltage applied to the cathode of the organic light-emitting diode device 20 shown in FIG. 5 goes higher.

If the second scan voltage source Vin2 is supplied with a lower voltage than the data voltage source Vdata so as to reduce the overshoot phenomenon, then a voltage of the data voltage source Vdata supplied to the anode of the organic light-emitting diode device 20 becomes larger than that of the second scan voltage source Vin2 supplied to the cathode of the organic light-emitting diode 20. In this case, there is raised a problem in that, as the organic light-emitting diode devices 20 at the selected lines as well as the remaining organic light-emitting diode devices 20 of the organic EL display device are forwardly biased, a light-emission is made while a current flowing in all the organic light-emitting diode devices 20.

SUMMARY OF THE INVENTION

Accordingly, it is an object of the present invention to provide a driving apparatus for an organic electro-luminescence display device that is adaptive for reducing a deterioration of organic light-emitting diode device in the organic electro-luminescence display device.

In order to achieve these and other objects of the invention, a driving apparatus for an organic electro-luminescence display device according to an embodiment of the present invention includes an organic light-emitting diode device; data supplying means for supplying a data signal to an anode of the organic light-emitting diode device; a first voltage source for generating a first voltage; a second voltage source for generating a second voltage higher than said first voltage; voltage stabilizing means for stabilizing said second voltage to be supplied to the cathode of the organic light-emitting diode device; and first and second switching devices for selectively applying said first and second voltages to a cathode of the organic light-emitting diode device.

In the driving apparatus, said first voltage is a ground voltage.

In the driving apparatus, the voltage stabilizing means is a Zener diode device, and the Zener diode device is connected, in series, between the second voltage source and the cathode of the organic light-emitting diode device.

Herein, a breakdown voltage of the Zener diode device is lower than a threshold voltage of the organic light-emitting diode device.

A voltage applied to the cathode of the organic light-emitting device is a difference voltage between a voltage supplied from the second voltage source and the breakdown voltage of the Zener diode device.

Alternatively, the voltage stabilizing means is a capacitor, and the capacitor is connected, in parallel, between the second voltage source and the cathode of the organic light-emitting diode device.

Herein, a voltage applied to the cathode of the organic light-emitting diode device has the same level as a voltage applied to the anode of the organic light-emitting diode device.

Otherwise, the voltage stabilizing means includes a Zener diode device and a capacitor; and the Zener diode device is connected, in series, between the second voltage source and the cathode of the organic light-emitting diode device, and the capacitor is connected, in parallel, between the Zener diode device and the cathode of the organic light-emitting diode device.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 6 to 14.

Figure 1:
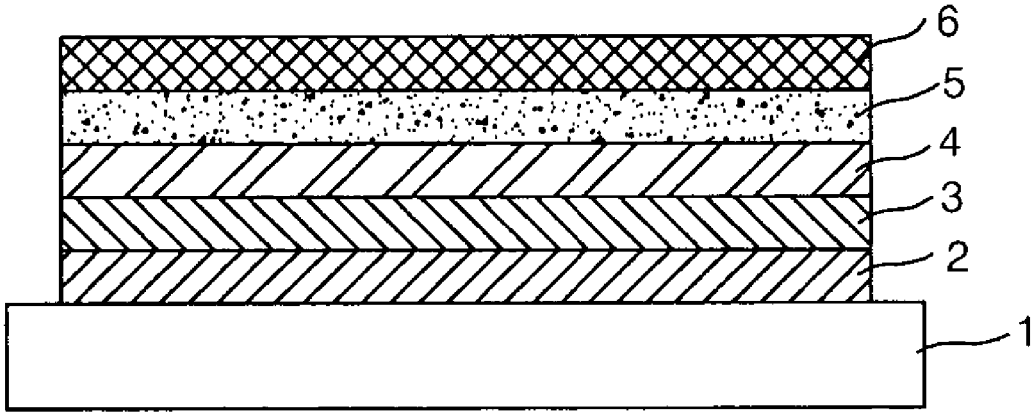
FIG. 1 RELATED ART
FIG. 1 is a schematic section view showing a structure of a conventional organic electro-luminescence display device.
Figure 2:
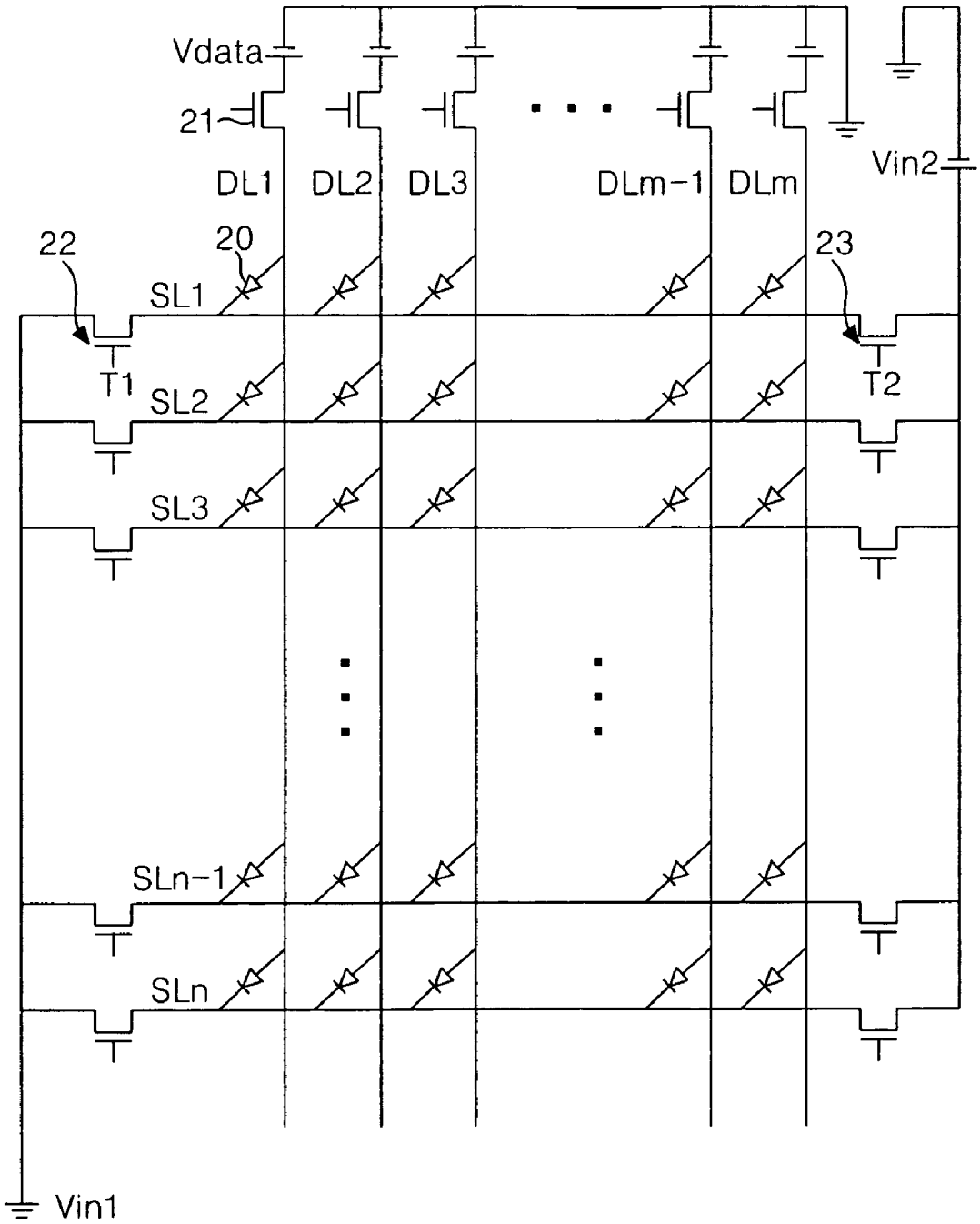
FIG.2 RELATED ART
FIG. 2 is a circuit diagram of a driving apparatus for the conventional organic electro-luminescence display device.
Figure 3:
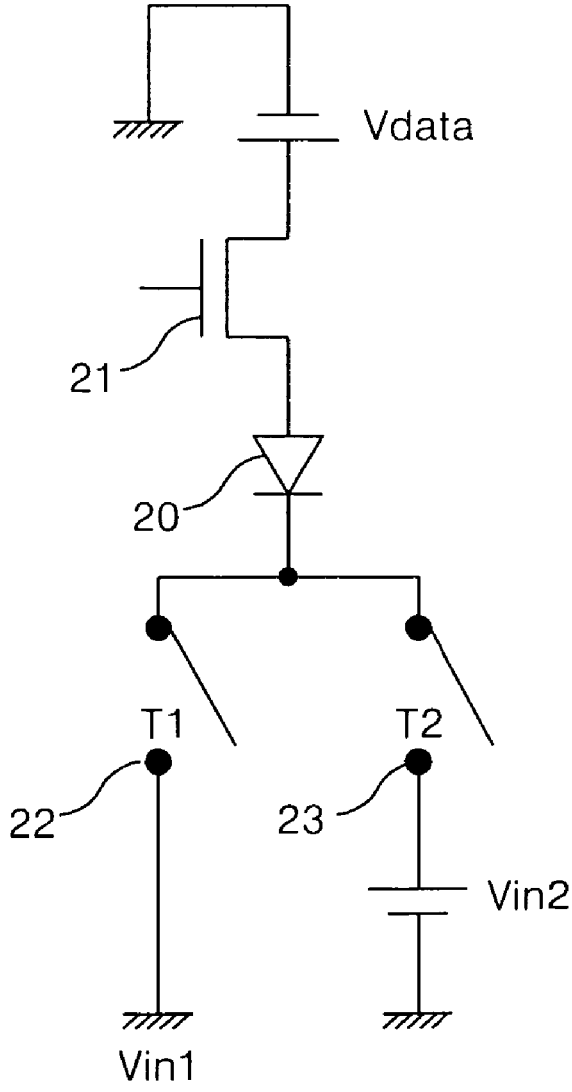
FIG. 3 RELATED ART
FIG. 3 is a circuit diagram for explaining an operation principle of an organic light-emitting diode device in the organic electro-luminescence display device shown in FIG. 2.
Figure 4:
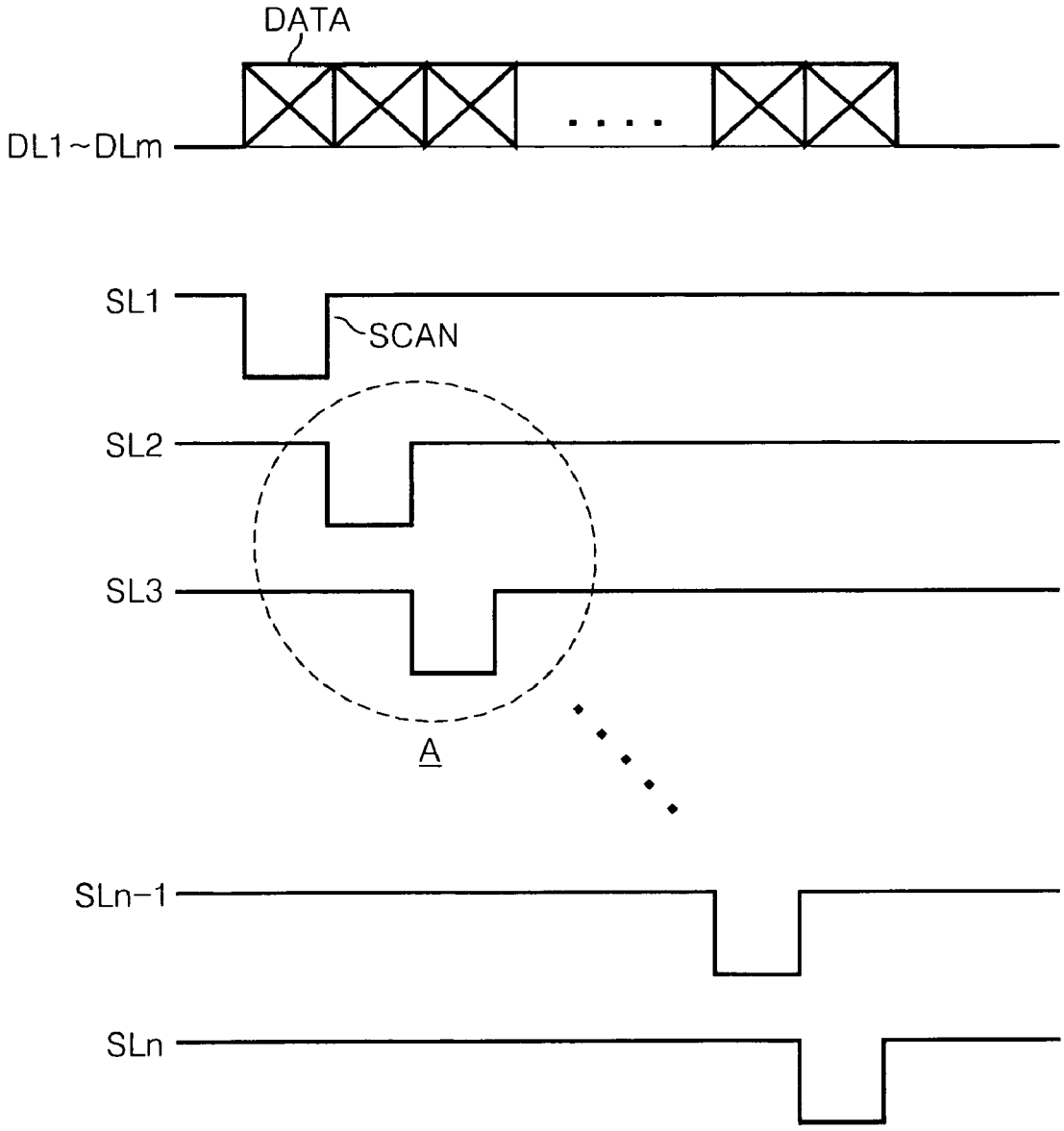
FIG. 4 RELATED ART
FIG. 4 is a driving waveform diagram of the organic electro-luminescence display device shown in FIG. 2.
Figure 5:
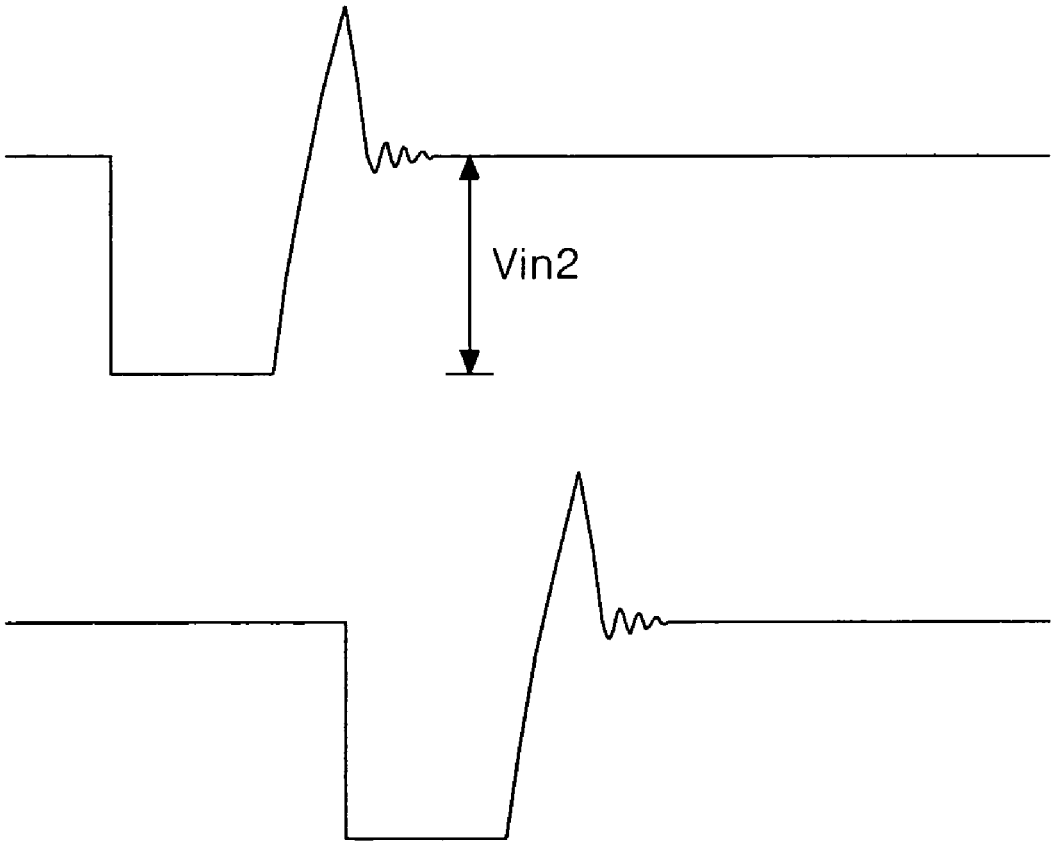
FIG. 5 RELATED ART
FIG. 5 is a detailed view of the A portion shown in FIG. 4.
Figure 6:
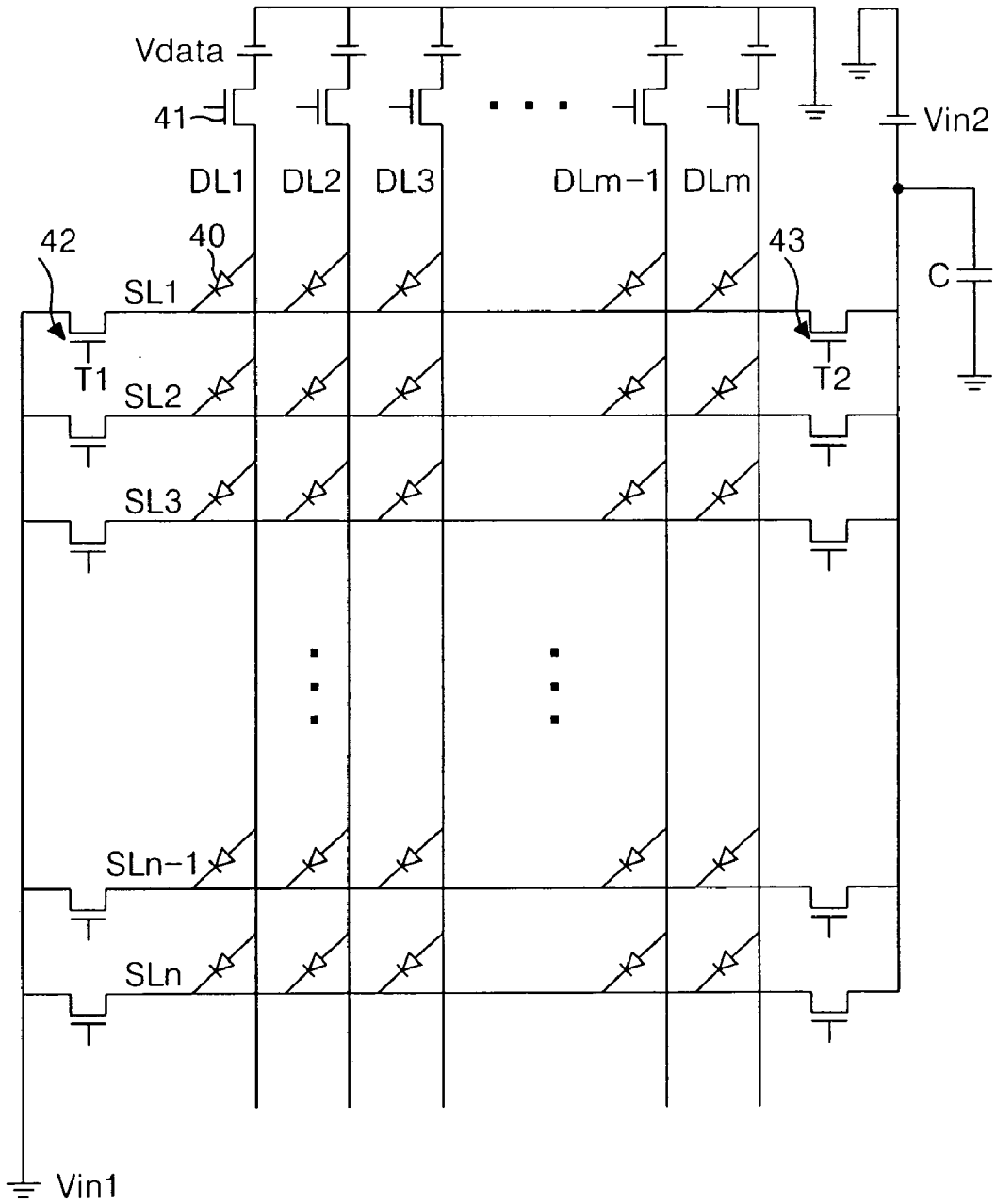
FIG. 6 is a circuit diagram of a driving apparatus for an organic electro-luminescence display device according to a first embodiment of the present invention.

FIG. 6 is a circuit diagram of a driving apparatus for an organic electro-luminescence display device according to a first embodiment of the present invention.

Referring to FIG. 6, the driving apparatus for the organic EL display device according to the first embodiment of the present invention includes a data voltage source Vdata connected to an anode of an organic light-emitting diode device 40, first and second scan voltage sources Vin1 and Vin2 connected to a cathode of the organic light-emitting diode device 40.

The data voltage source Vdata supplies a positive voltage to data lines DL1 to DLm connected to the anode of the organic light-emitting diode device while the first and second scan voltage sources Vin1 and Vin2 supply a negative voltage and a positive voltage to scan lines SL1 to SLn connected to the cathode of the organic light-emitting diode device 40.

Further, the driving apparatus includes data switching devices 41 connected between the anode of the organic light-emitting diode device 40 and the data voltage source Vdata, first and second switching devices 42 and 43 connected between the cathode of the organic light-emitting diode device 40 and the first and second scan voltage sources Vin1 and Vin2, respectively, and a capacitor C connected, in parallel, between the second scan voltage source Vin2 and the second switching device 43.

The capacitor C charges a voltage applied from the anode of the organic light-emitting diode device 40 to the cathode thereof at a fast time when a scanning pulse SCAN applied to the scan lines SL1 to SLn is switched from a negative polarity into a positive polarity, thereby stabilizing a voltage of the output terminal to reduce an overshoot phenomenon.

Figure 7:
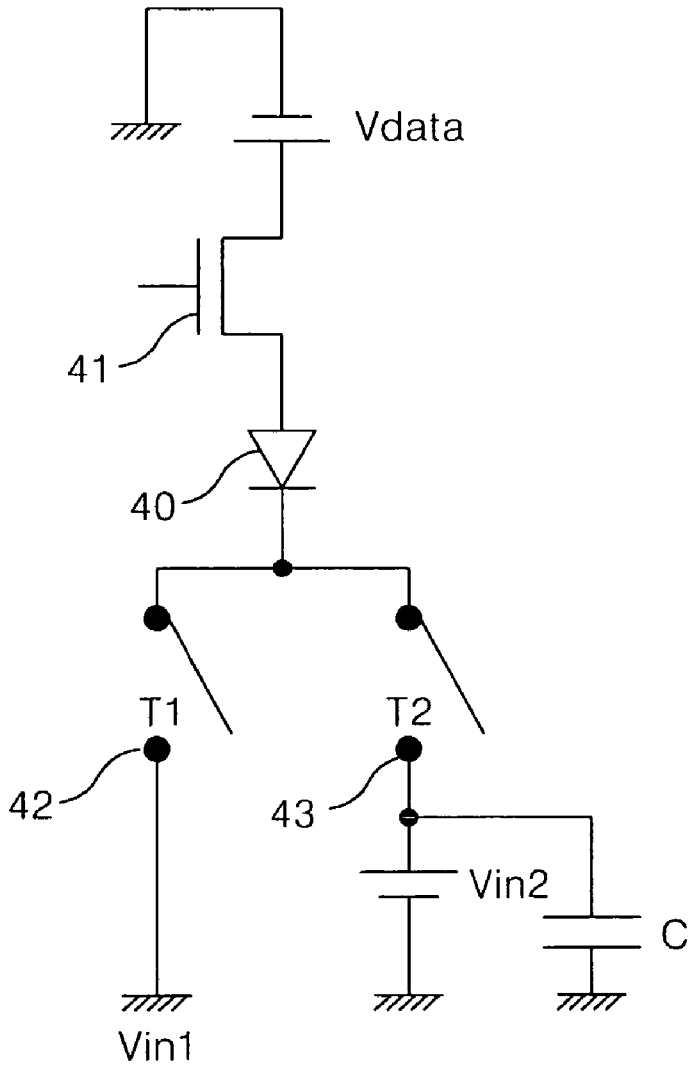
FIG. 7 is a circuit diagram for explaining an operation principle of an organic light-emitting diode device in the organic electro-luminescence display device shown in FIG. 6.
Figure 8:
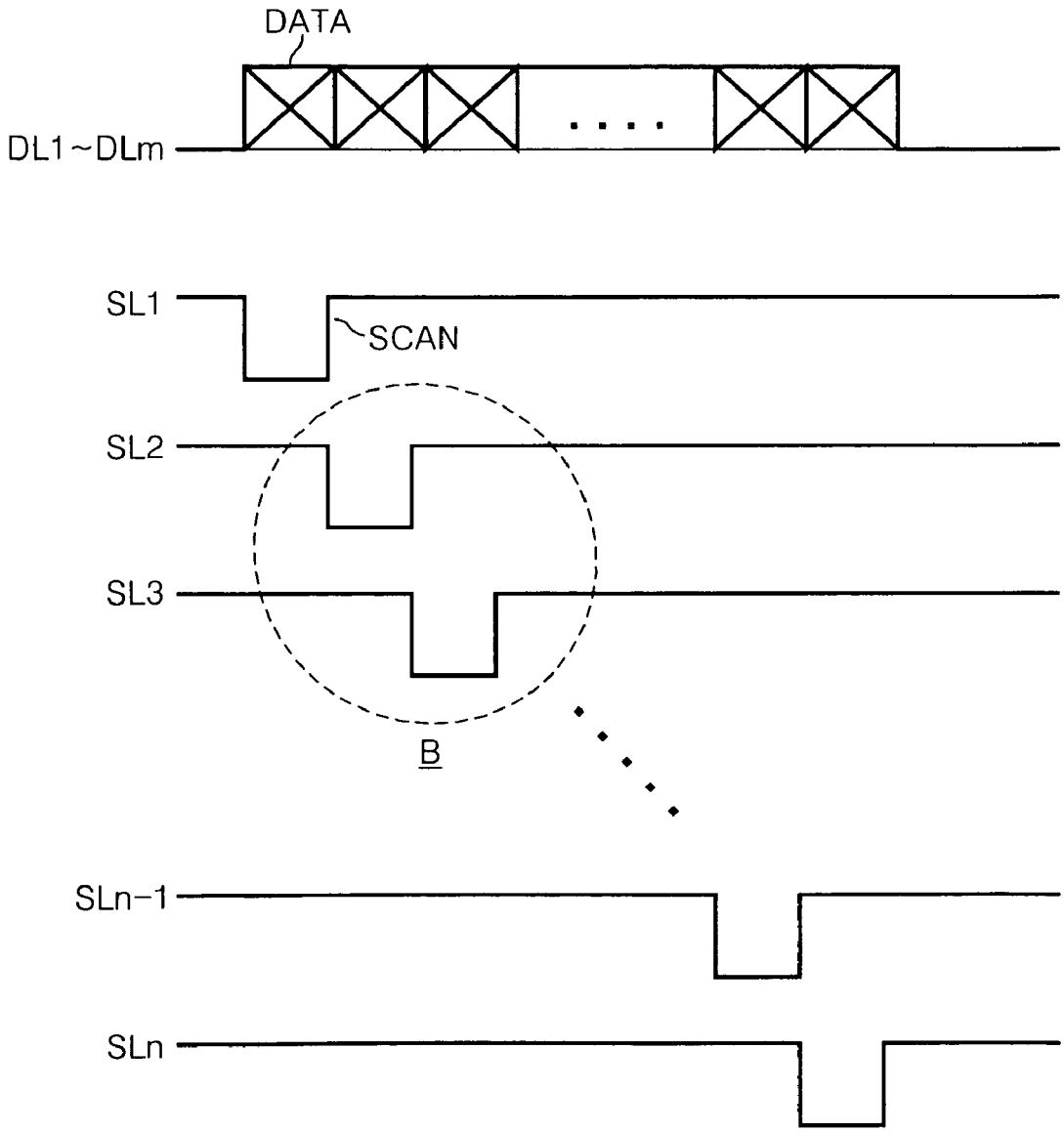
FIG. 8 is a driving waveform diagram of the organic electro-luminescence display device shown in FIG. 6.

FIG. 7 is a circuit diagram for explaining an operation principle of an organic light-emitting diode device in the organic electro-luminescence display device shown in FIG. 6, and FIG. 8 is a driving waveform diagram of the organic electro-luminescence display device shown in FIG. 6. Further, FIG. 9 is a detailed view of the B portion shown in FIG. 8.

Figure 9:
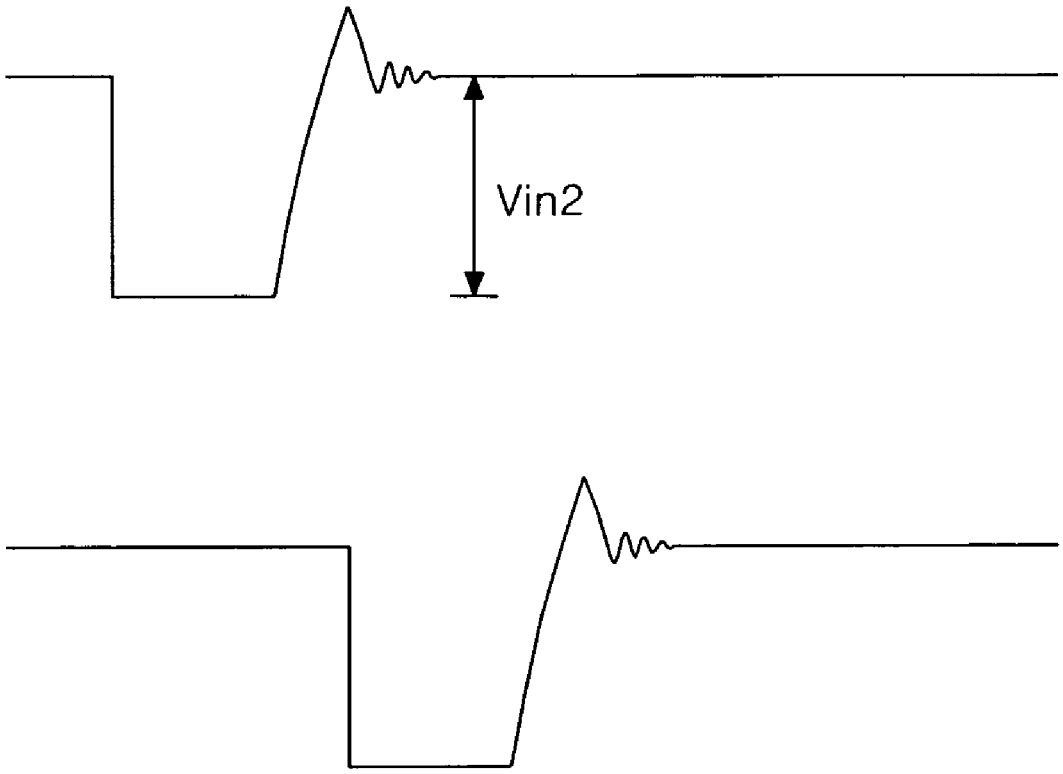
FIG. 9 is a detailed view of the B portion shown in FIG. 8.

Referring to FIG. 7 to FIG. 9, the first switching devices 42 are sequentially turned on in response to a control signal T1 to thereby sequentially apply a scanning pulse SCAN having a negative voltage, that is, a forward voltage to the scan lines SL1 to SLn. A data pulse DATA is synchronized with the scanning pulse SCAN applied to the scan lines SL1 to SLn to be applied to the data lines DL1 to DLm as a positive voltage.

More specifically, as the first switching device 42 connected to the first scan line SL1 is turned on in response to the control signal T1, the scanning pulse SCAN is applied to the first scan line SL1 as a negative voltage. The data pulse DATA is synchronized with the scanning pulse SCAN to be applied to the data lines DL1 to DLm as a positive voltage. When a negative voltage is applied to the first scan line SL1 and a positive voltage is applied to the data lines DL1 to DLm', the organic light-emitting diode device 40 at the first line flows a current to make a light emission by a forward bias. Thereafter, as the second switching device 43 connected to the first scan line SL1 is turned on in response to a control signal T2, the scanning pulse SCAN is applied to the first scan line SL1 as a positive voltage. While the control signal T2 supplying a positive voltage to the first scan line SL1 and the first control signal T1 supplying a negative voltage to the second scan line SL2 being applied, the organic EL display device sequentially emits a light to display a picture.

When the scanning pulse SCAN applied to the scan lines SL1 to SLn is switched from a negative voltage into a positive voltage, an overshoot caused by the switching emerges from the scanning pulse SCAN.

Such an overshoot appearing at the scan lines SL1 to SLn can be reduced by the capacitor C connected, in parallel, between the second scan voltage source Vin2 and the second switching device 43.

The capacitor C charges a voltage applied from the anode of the organic light-emitting diode device 40 to the cathode thereof at a fast time when a scanning pulse SCAN applied to the scan lines SL1 to SLn is switched from a negative polarity into a positive polarity, thereby stabilizing a voltage of the output terminal to reduce an overshoot phenomenon.

Figure 10:
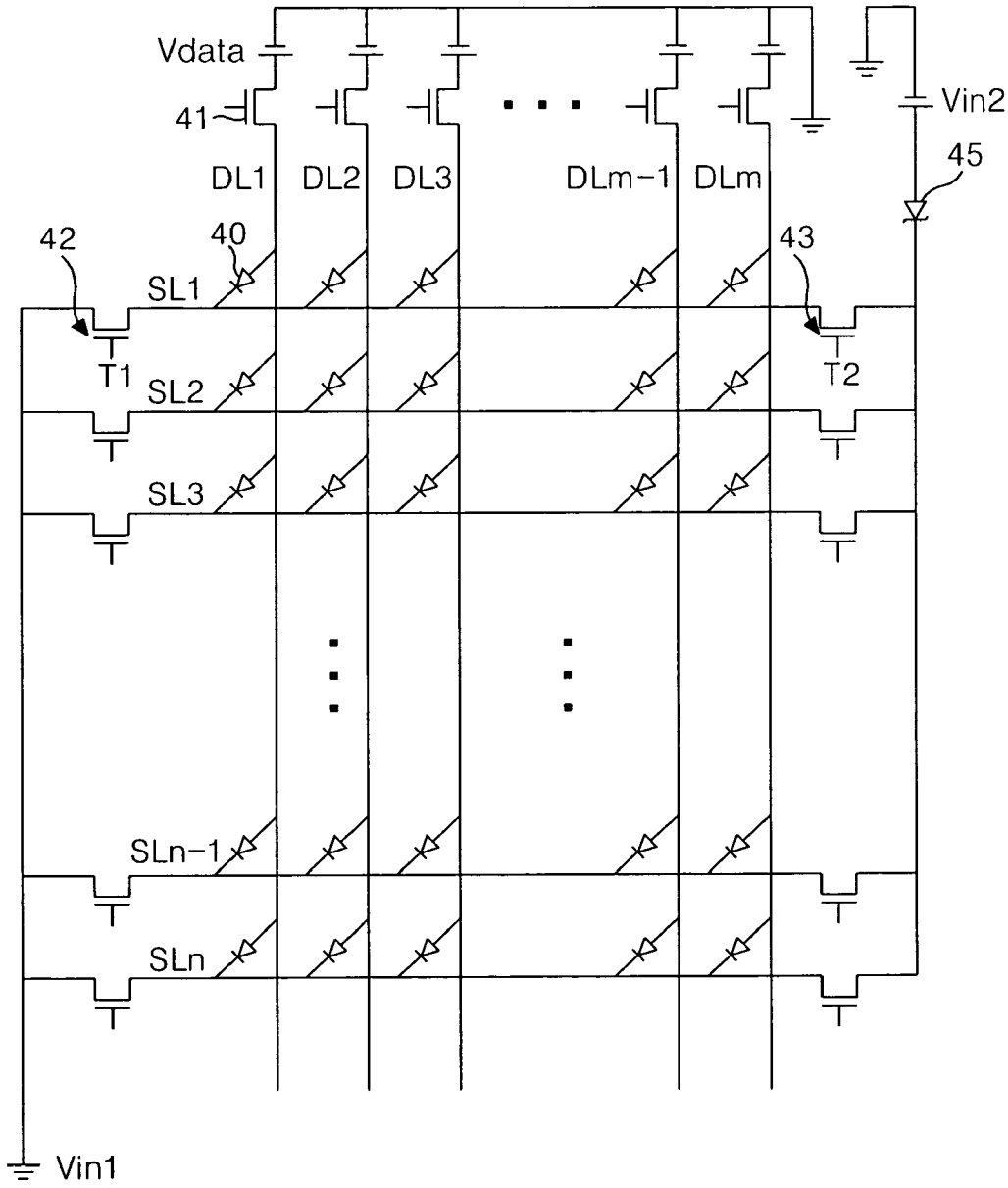
FIG. 10 is a circuit diagram of a driving apparatus for an organic electro-luminescence display device according to a second embodiment of the present invention.

FIG. 10 is a circuit diagram of a driving apparatus for an organic electro-luminescence display device according to a second embodiment of the present invention.

The driving apparatus for the organic EL display device according to the second embodiment of the present invention as shown in FIG. 10 has the same elements as that according to the first embodiment of the present invention shown in FIG. 6 except that the capacitor C connected, in parallel, between the second voltage source Vin2 and the second switching device 43 is replaced by a Zener diode device 45 connected, in series, between the second voltage source Vin2 and the second switching device 43.

The Zener diode device 45 plays a role to limit a voltage of a second scan voltage source Vin2 applied to a cathode of an organic light-emitting device 40 into a constant voltage, thereby reducing an overshoot phenomenon.

Figure 11:
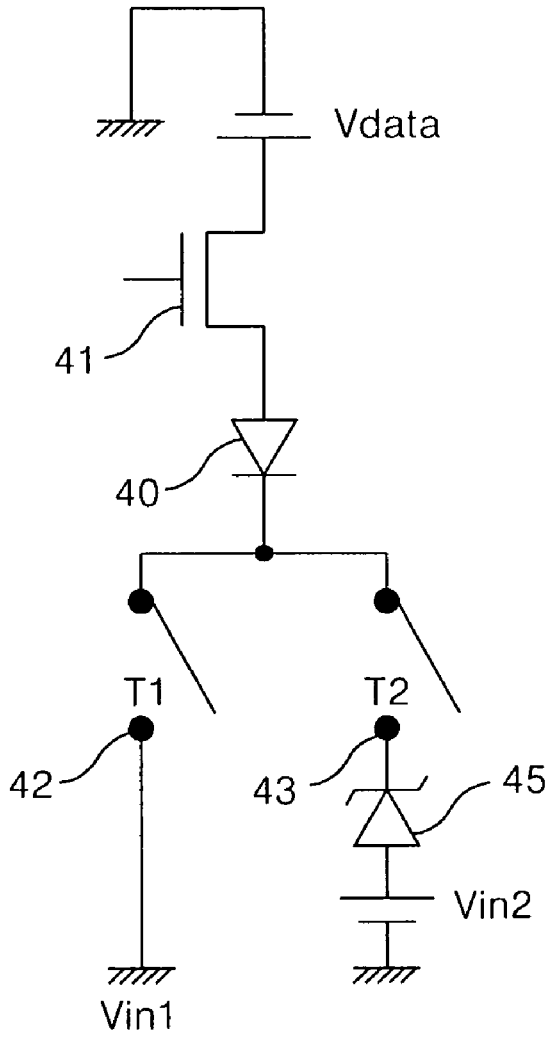
FIG. 11 is a circuit diagram for explaining an operation principle of an organic light-emitting diode device in the organic electro-luminescence display device shown in FIG. 10.
Figure 12:
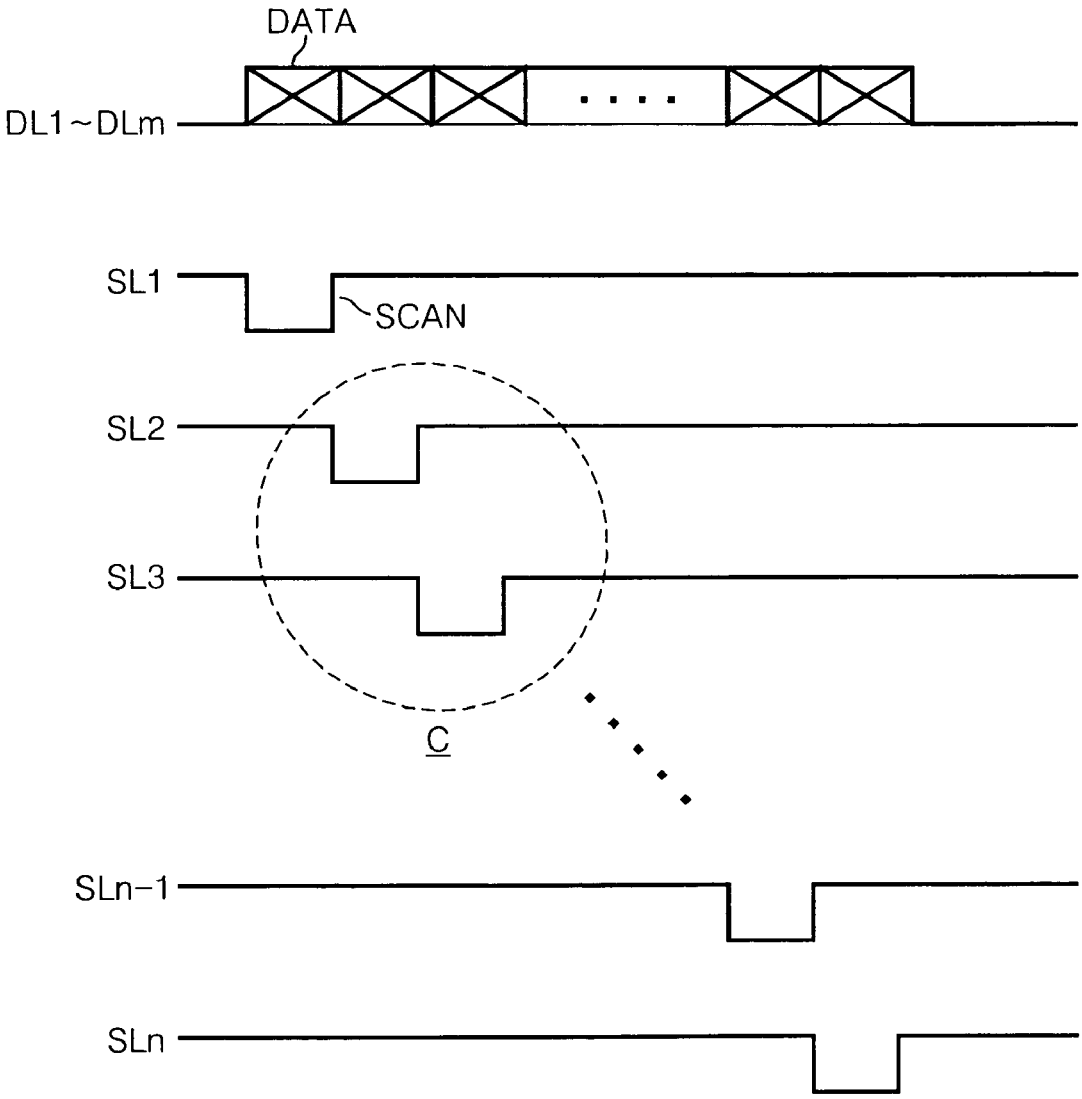
FIG. 12 is a driving waveform diagram of the organic electro-luminescence display device shown in FIG. 10.

FIG. 11 is a circuit diagram for explaining an operation principle of an organic light-emitting diode device in the organic electro-luminescence display device shown in FIG. 10, and FIG. 12 is a driving waveform diagram of the organic electro-luminescence display device shown in FIG. 10.

Referring to FIG. 11 and FIG. 12, first switching devices 42 are sequentially turned on in response to a control signal T1 to thereby sequentially apply a scanning pulse SCAN having a negative voltage, that is, a forward voltage to scan lines SL1 to SLn. A data pulse DATA is synchronized with the scanning pulse SCAN applied to the scan lines SL1 to SLn to be applied to the data lines DL1 to DLm as a positive voltage.

When the scanning pulse SCAN applied to the scan lines SL1 to SLn is switched from a negative voltage into a positive voltage, an overshoot caused by the switching emerges from the scanning pulse SCAN.

Such an overshoot appearing at the scan lines SL1 to SLn can be reduced by the Zener diode device 45 connected, in series, between the second scan voltage source Vin2 and the second switching device 43.

The Zener diode device 45 acts as a constant voltage source for limiting a voltage of the second scan voltage source Vin2 applied to the cathode of the organic light-emitting diode device 40 into a constant voltage.

In other words, when the scanning pulse SCAN is switched from a negative voltage into a positive voltage, a positive voltage Vhigh applied to the scan lines SL1 to SLn results in a difference between a positive voltage supplied from the second voltage source Vin2 and a breakdown voltage Vz of the Zener diode device 45.

This can be expressed by the following equation:

$$V\text{high}=Vin2-|Vz| \quad (1)$$

Accordingly, when the scanning pulse SCAN is switched from a negative voltage into a positive voltage, the positive voltage Vhigh applied to the cathode of the organic light-emitting diode device 40 has a lower voltage than the prior art, thereby reducing an overshoot phenomenon. At this time, the breakdown voltage Vz of the Zener diode device 45 must be smaller than a threshold voltage Vth of the organic light-emitting diode device 40.

If the breakdown voltage Vz of the Zener diode 45 is larger than or equal to the threshold voltage Vth of the organic light-emitting diode device 40, then a difference between a voltage from the data voltage source Vdata connected to the anode of the organic light-emitting diode device 40 and a positive voltage Vhigh applied to the cathode of the organic light-emitting diode device 40 becomes larger then the threshold voltage Vth of the organic light-emitting diode device 40 when the second switching device 43 is turned on. Thus, a forward bias is applied to the organic light-emitting diode device 40 and a current flow in the organic light-emitting diode device by a voltage applied to the organic light emitting diode device 40, thereby allowing the organic light-emitting diode device 40 to make a light emission.

For this reason, the breakdown of the Zener diode device 45 must be lower than the threshold voltage Vth of the organic light-emitting diode device 40.

This can be expressed by the following equation:

$$|Vz|<Vth \quad (2)$$

Figure 13:
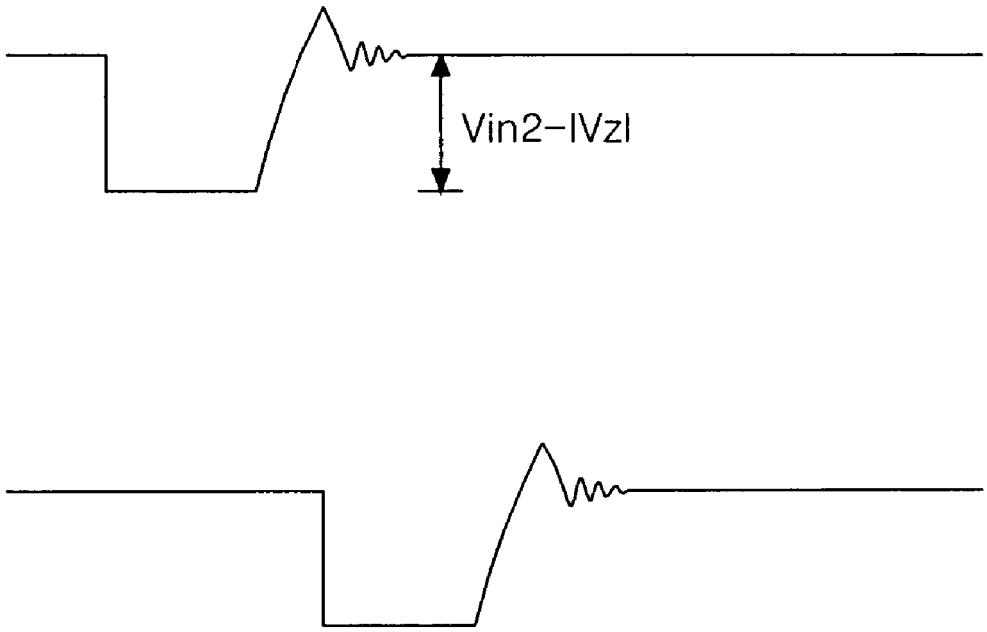
FIG. 13 is a detailed view of the C portion shown in FIG. 12.

FIG. 13 is a detailed view of the C area shown in FIG. 12.

Referring to FIG. 13, a positive voltage applied to the scan lines SL1 to SLn becomes a difference between the voltage supplied from the second scan voltage source Vin2 and the breakdown voltage Vz of the Zener diode 45, which lowers a magnitude of the positive voltage applied to the cathode of the organic light-emitting diode device 40, thereby reducing an overshoot phenomenon.

Figure 14:
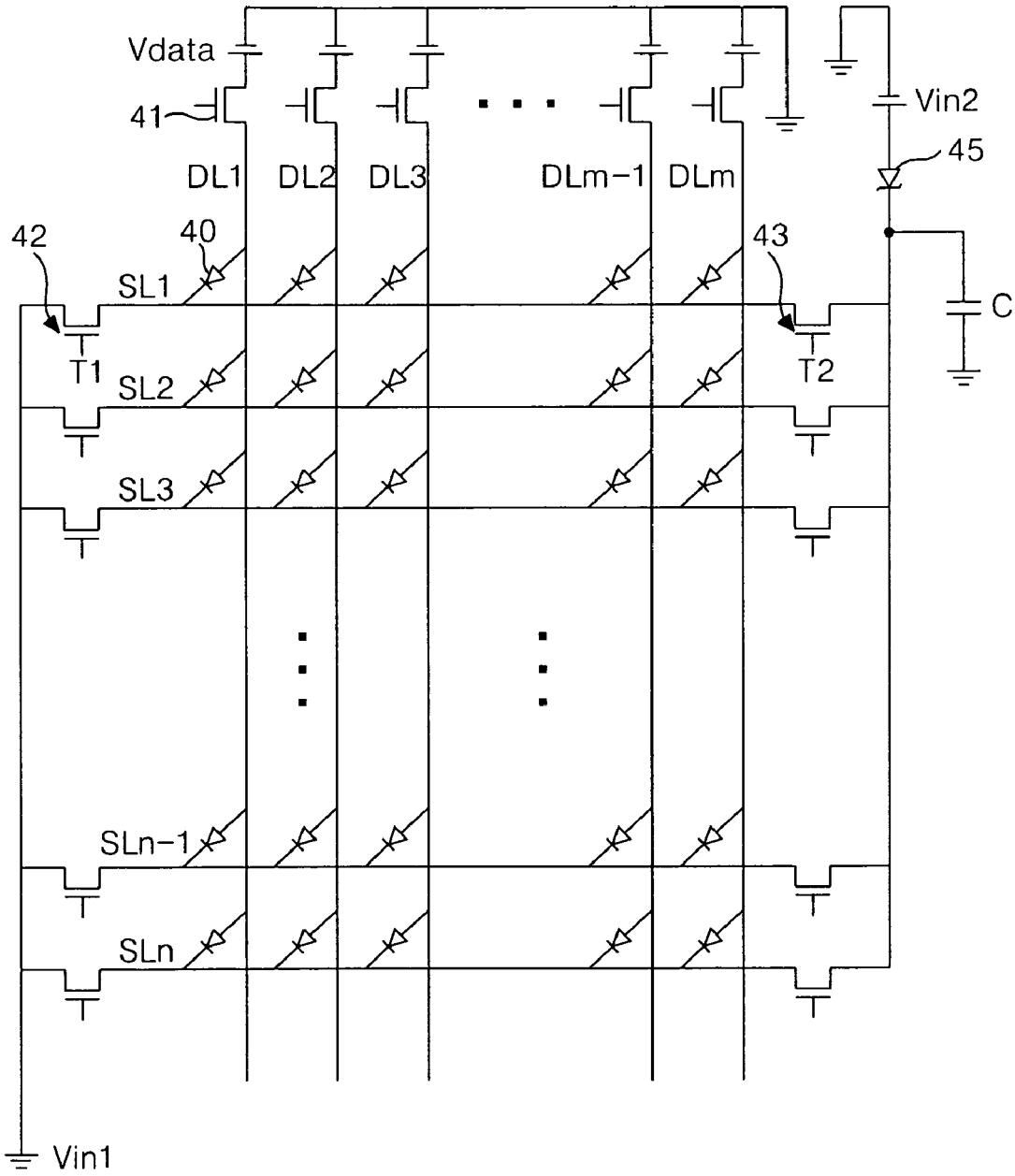
FIG. 14 is a circuit diagram of a driving apparatus for an organic electro-luminescence display device according to a third embodiment of the present invention.
Figure 15:
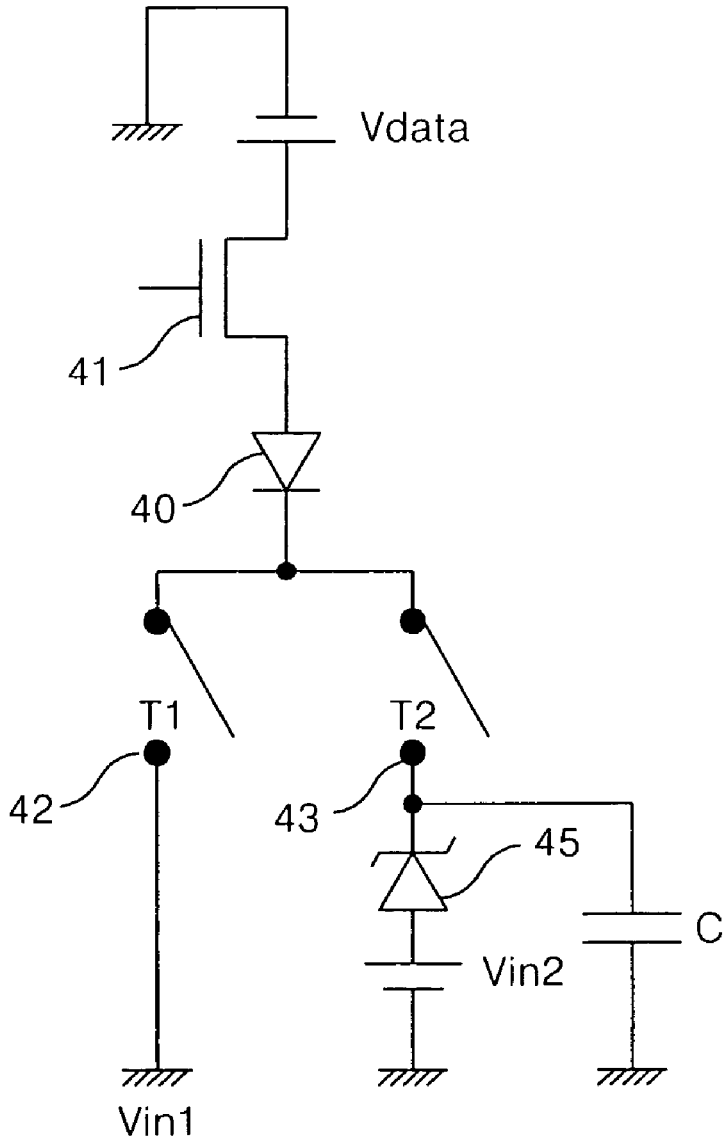
FIG. 15 is a circuit diagram for explaining an operation principle of an organic light-emitting diode device in the organic electro-luminescence display device shown in FIG. 14.

FIG. 14 is a circuit diagram of a driving apparatus for an organic electro-luminescence display device according to a third embodiment of the present invention, and FIG. 15 is a circuit diagram for explaining an operation principle of an organic light-emitting diode device in the organic electro-luminescence display device shown in FIG. 14.

The driving apparatus for the organic EL display device according to the third embodiment of the present invention as shown in FIG. 14 has the same elements as that according to the first embodiment of the present invention shown in FIG. 6 except that it includes a Zener diode device 45 connected, in series, between the second voltage source Vin2 and the second switching device 43, and a capacitor C connected, in parallel, between the second scan voltage source Vin2 and the Zener diode device 45.

The Zener diode device 45 plays a role to limit a voltage of a second scan voltage source Vin2 applied to a cathode of an organic light-emitting device 40 into a constant voltage, thereby reducing an overshoot phenomenon.

Further, the capacitor C charges a voltage applied from the anode of the organic light-emitting diode device 40 to the cathode thereof at a fast time when a scanning pulse SCAN applied to the scan lines SL1 to SLn is switched from a negative polarity into a positive polarity, thereby stabilizing a voltage of the output terminal to reduce an overshoot phenomenon.

Referring to FIG. 15, when the scanning pulse SCAN applied to the scan lines SL1 to SLn is switched from a negative voltage into a positive voltage, an overshoot caused by the switching emerges from the scanning pulse SCAN.

Such an overshoot appearing at the scan lines SL1 to SLn can be reduced by the Zener diode device 45 connected, in series, between the second scan voltage source Vin2 and the second switching device 43. Also, the overshoot can be more reduced by the capacitor C connected, in parallel, between the second voltage source Vin2 and the Zener diode device 45.

The Zener diode device 45 acts as a constant voltage source for limiting a voltage of the second scan voltage source Vin2 applied to the cathode of the organic light-emitting diode device 40 into a constant voltage.

In other words, when the scanning pulse SCAN is switched from a negative voltage into a positive voltage, a positive voltage Vhigh applied to the scan lines SL1 to SLn results in a difference between a positive voltage supplied from the second voltage source Vin2 and a breakdown voltage Vz of the Zener diode device 45.

This can be expressed by the following equation:

$$Vhigh = Vin2 - |Vz| \quad (3)$$

Accordingly, when the scanning pulse SCAN is switched from a negative voltage into a positive voltage, the positive voltage Vhigh applied to the cathode of the organic light-emitting diode device 40 has a lower voltage than the prior art, thereby reducing an overshoot phenomenon.

As mentioned above, the breakdown voltage Vz of the Zener diode device 45 must be lower than a threshold voltage Vth of the organic light-emitting diode device 40.

This can be expressed by the following equation:

$$|Vz| < Vth \quad (4)$$

Further, the capacitor C charges a voltage applied from the anode of the organic light-emitting diode device 40 at a fast time when a scanning pulse SCAN applied to the scan lines SL1 to SLn is switched from a negative polarity into a positive polarity, thereby stabilizing a voltage of the output terminal to reduce an overshoot phenomenon.

As described above, the driving apparatus for the organic EL display device according to the embodiments of the present invention includes any one of the Zener diode device connected, in series, between the second scan voltage source and the second switching device and the capacitor connected, in parallel, between the second scan voltage source and the Zener diode device.

Accordingly, the capacitor charges a voltage applied from the anode of the organic light-emitting diode device to the cathode thereof at a fast time, thereby stabilizing a voltage of the output terminal to reduce an overshoot phenomenon. Furthermore, the Zener diode device allows a positive voltage supplied to the cathode of the organic light-emitting diode device to have a lower voltage than the prior art when the scanning pulse is switched from a negative voltage into a positive voltage, thereby reducing an overshoot phenomenon. As a result, it becomes possible to reduce a deterioration of organic light-emitting diode device.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for an organic electro-luminescence display device, comprising:

an organic light-emitting diode device having an anode and a cathode;

data voltage source configured to supply a data voltage to the anode of the organic light-emitting diode device;

a first voltage source configured to generate a first voltage;

a second voltage source configured to generate a second voltage higher than said first voltage;

voltage stabilizing means connected to the second voltage source and configured to stabilize said second voltage to be supplied to the cathode of the organic light-emitting diode; and first and second switching devices configured to selectively apply said first and second voltages to a cathode of the organic light-emitting diode device, wherein the voltage stabilizing means is a Zener diode device, and the Zener diode device is connected, in series, between the second voltage source and the cathode of the organic light-emitting diode device, and wherein a breakdown voltage of the Zener diode device is lower than a threshold voltage of the organic light-emitting diode device.

2. The driving apparatus according to claim 1, wherein said first voltage is a ground voltage.

3. The driving apparatus according to claim 1, wherein a voltage applied to the cathode of the organic light-emitting device is a difference voltage between a voltage supplied from the second voltage source and the breakdown voltage of the Zener diode device.

4. The driving apparatus according to claim 1, wherein the voltage stabilizing means includes a capacitor; and the capacitor is connected, in parallel, between the Zener diode device and the cathode of the organic light-emitting diode device.

* * * * *